US006571998B2

(12) United States Patent
Godshaw et al.

(10) Patent No.: US 6,571,998 B2
(45) Date of Patent: Jun. 3, 2003

(54) FRAMED, SOFT SIDED CARRIER FOR TOOLS

(75) Inventors: Donald E. Godshaw, Evanston, IL (US); Andrzej M. Redzisz, Skokie, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/838,908

(22) Filed: Apr. 20, 2001

(65) Prior Publication Data

US 2002/0130151 A1 Sep. 19, 2002

Related U.S. Application Data

(60) Provisional application No. 60/198,966, filed on Apr. 21, 2000.

(51) Int. Cl.[7] ..... A45F 3/02

(52) U.S. Cl. ..... 224/607; 206/373; 224/682; 224/683; 224/684

(58) Field of Search ..... 224/607, 904, 224/266, 682, 683, 684; 206/364, 366, 373, 372

(56) References Cited

U.S. PATENT DOCUMENTS

| | | | | | |
|---|---|---|---|---|---|
| 5,361,412 | A | * | 11/1994 | Perry | 2/102 |
| 5,833,095 | A | * | 11/1998 | Russell et al. | 206/373 |
| 5,863,088 | A | * | 1/1999 | Kelly et al. | 224/250 |
| 6,179,185 | B1 | * | 1/2001 | Dancyger | 206/373 |
| 6,213,366 | B1 | * | 4/2001 | LaRocco | 224/268 |
| 6,435,389 | B1 | * | 8/2002 | Sucher | 224/576 |

* cited by examiner

*Primary Examiner*—Stephen K. Cronin
*Assistant Examiner*—Maerena W. Brevard

(57) ABSTRACT

A collapsible bag or container includes first and second major pockets separated by a connecting web into which a metal frame is removably inserted. Loops and handles project through the web for attachment of a carrier strap or manual handle.

6 Claims, 4 Drawing Sheets

FIG.2
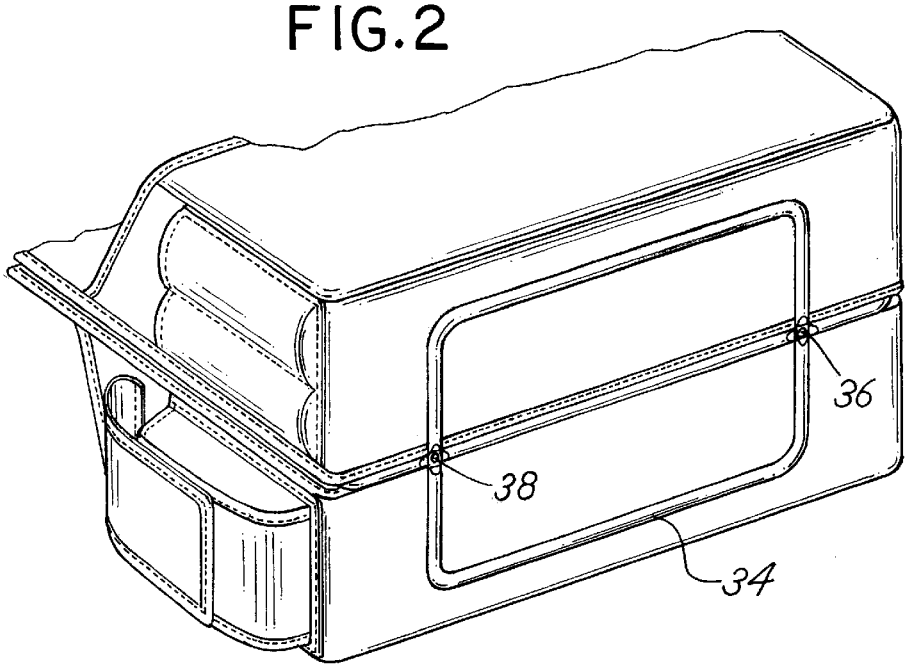
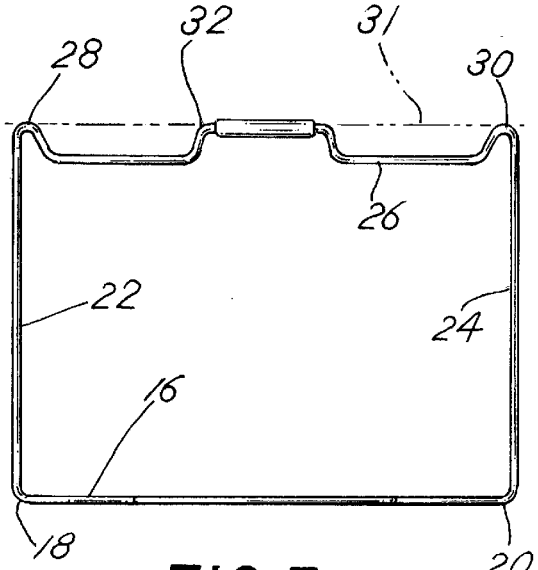
FIG.3
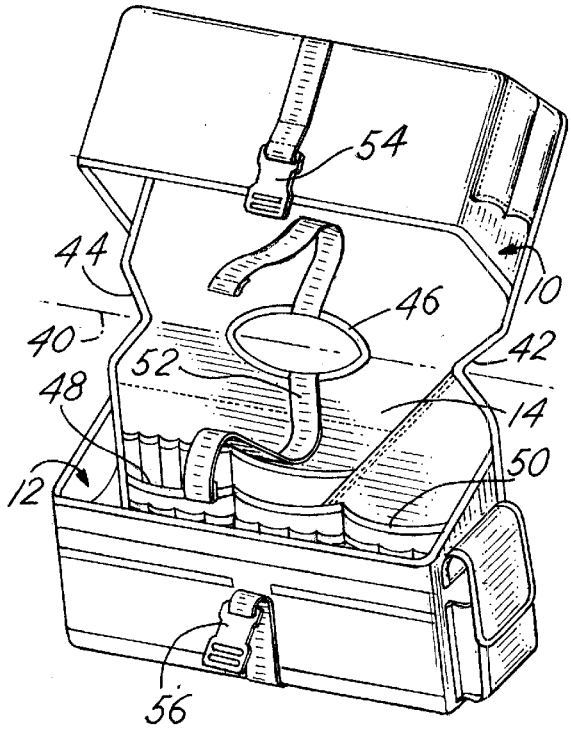
FIG.4

FIG. 5
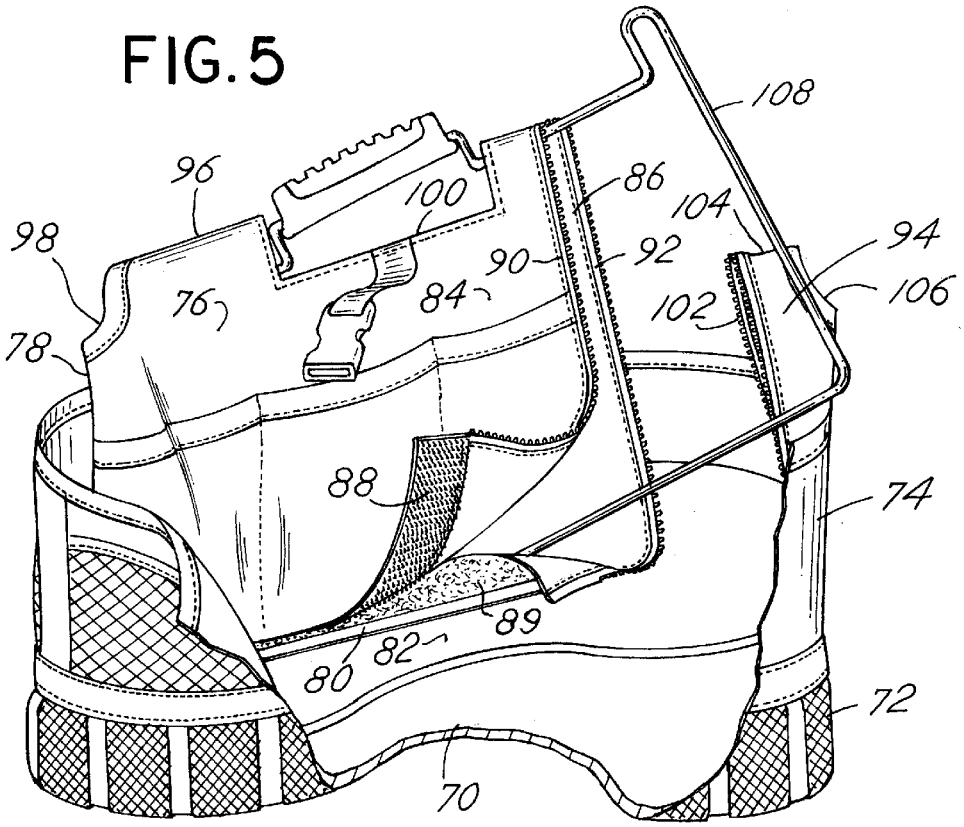
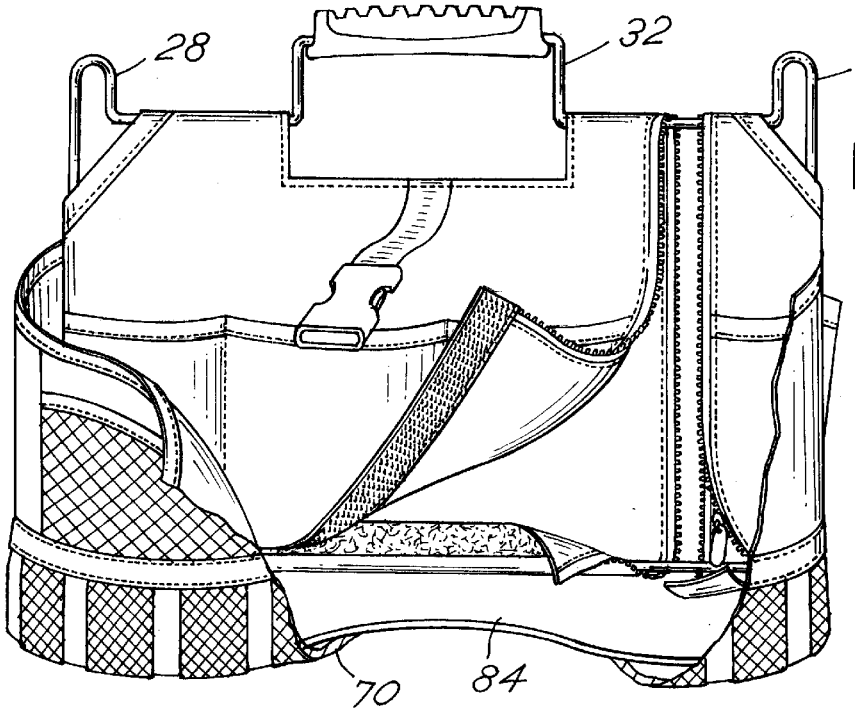
FIG. 6

FRAMED, SOFT SIDED CARRIER FOR TOOLS

CROSS REFERENCE TO RELATED APPLICATION

This is a utility application based upon a previously filed provisional application, Ser. No. 60/198,966 filed Apr. 21, 2000.

BACKGROUND OF THE INVENTION

In a principal aspect the present invention relates to a collapsible carrier for tools and other similar articles comprised of a flexible bag and a wire frame which is used in combination with the bag.

Tradesmen and craftsmen often find it necessary to carry multiple tools for practice of their trade. Various types of bags and containers have been developed to facilitate the transport of such tools. Often such bags or containers are fabricated from a fabric such as canvas or a vinyl material. Various designs of such containers or bags are available. Nonetheless there remains a need for improved designs and further the need for designs which are collapsible and may be folded for ease of transport and for appropriate ease of packaging in order to market the products.

SUMMARY OF THE INVENTION

Briefly, the present invention comprises a collapsible tool carrier or bag comprised of first and second principal, open top pockets with a connecting web separating the two separate, principal pockets. The web is constructed of opposed web panels that define an enclosure or slot. A wire frame is inserted in the enclosure or slot between the opposed panels. The frame includes loops that project from openings provided in top seam or the juncture between the opposed web panels. End loops in the frame are provided for a shoulder strap and a handle loop is incorporated at the middle of the frame. Various embodiments of the invention are depicted including an embodiment comprised of a flexible container having the configuration of a saddle bag, and a flexible sided container wherein the bottom of the container is rigid with a mid-panel or web pocket into which the wire frame is inserted and retained by means of a fastener such as a zipper.

Thus it is an object of the invention to provide improved collapsible tool bag or container comprised of first and second main pockets separated by midpanel or web construction which is adapted to receive a reinforcing wire frame.

It is another object of the invention to provide a collapsible carrier bag or container which may include multiple pockets and straps to facilitate the storage and carriage of tools and items of various shapes and sizes.

Yet another object of the invention is to provide a collapsible tool bag or carrier which is economical, light weight, easy to assemble, easy to disassemble and package, and rugged.

These and other objects, advantages, and features of the invention will be set forth in a detailed description which follows.

BRIEF DESCRIPTION OF THE DRAWING

In the detailed description which follows, reference will be made to the drawing comprised of the following figures:

FIG. 2 is a bottom isometric view of the tool carrier of FIG. 1;

FIG. 3 is an elevation of the wire frame which is used in the collapsible tool carrier;

FIG. 4 is an isometric view of the fabric bag which is utilized with the wire frame of FIG. 3 to provide the collapsible tool carrier of the invention; and FIG. 5 is an isometric view of an alternative embodiment of the invention;

FIG. 6 is an isometric view of the embodiment of FIG. 5 partially assembled for use.

DESCRIPTION OF THE PREFERRED EMBODIMENTS

Figure 1:
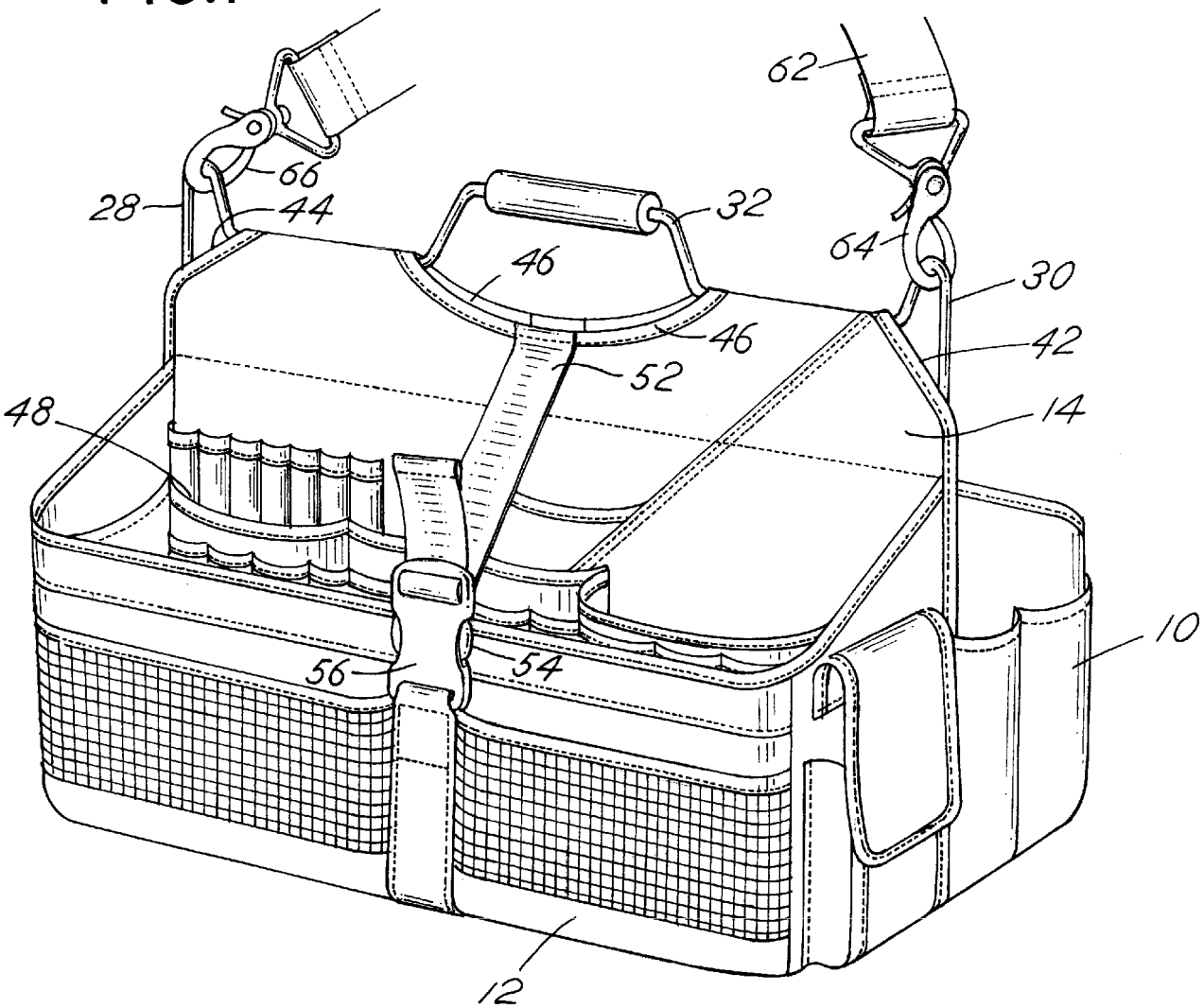
FIG. 1 is an isometric view of the assembled collapsible tool carrier of the invention.

Referring to the figures, the collapsible portable tool carrier of the invention is comprised of two basic component parts: a wire frame, such as depicted in FIG. 3 and a fabric bag having first and second separate pockets 10 and 12 and a connecting web 14 between the pockets 10, 12 as depicted in FIG. 4. The following description of a first embodiment will be directed to the wire frame to be followed by a description of the fabric bag.

The wire frame includes a straight bottom run 16 having first and second spaced ends 18 and 20. A first frame side 22 extends upwardly from the end 18. A second parallel, spaced frame side 24 extends upwardly from the end 20. The frame sides 22 and 24 are connected by a top run 26. The top run 26 includes a first end loop 28 and a second, spaced end loop 30 at the junction, respectively, of the top run 26 and the side frame run 22 and the top run 26 and the side frame run 24. A middle handle section 32 in the form of a loop is defined in the top run 26. The loops 28, 30, as well as the handle section 32 are generally aligned along a line 31 which is spaced from and parallel to the bottom run 16. An optional rectangular frame 34 is affixed to the bottom run 16 transversely thereto and connected by screws or fasteners 36 and 38.

Referring next to FIGS. 1 and 4, there is depicted in greater detail the construction of the fabric bag or carrier. The fabric bag may be constructed from a material such as canvas or the like. The bag includes a first pocket 10 and a separate second pocket 12 separated and connected by a connecting web 14. The connecting web 14 defines a middle axis 40. In a preferred embodiment of the invention, the axis 40 is an axis of symmetry of the pockets 10 and 12. The bag assembly thus has the form of a saddle bag.

The web 14 includes a first notch 42 on one side thereof and a second notch 44 on the opposite side thereof. An intermediate opening 46 is defined on the axis 40 between the notches 42 and 44. Each pocket 10, 12 may include a series of pouches or subpockets, such as subpockets 48 and 50 for holding various tools. Web 14 further includes a strap 52 attached thereto extending from opening 46 with a connector 54 which may be attached to a strap and connector 56 attached to the outside of pocket 12 to hold the tools and the pocket 12 in a supported condition. The pocket 10 has a similar symmetric construction through the arrangement and configuration of ancillary pockets or pouches may be varied.

It will be noted by referring to FIG. 1 that the web 14 is folded over the top run 26 of the frame with the handle 32 projecting through the opening 46 and the loops 28 and 30 projecting through the notches 44 and 42, respectively. A carrying strap 62 with attachment clips or latches 64 and 66 may then be attached to the loops 28 and 30 for support of the bag.

Figure 7:
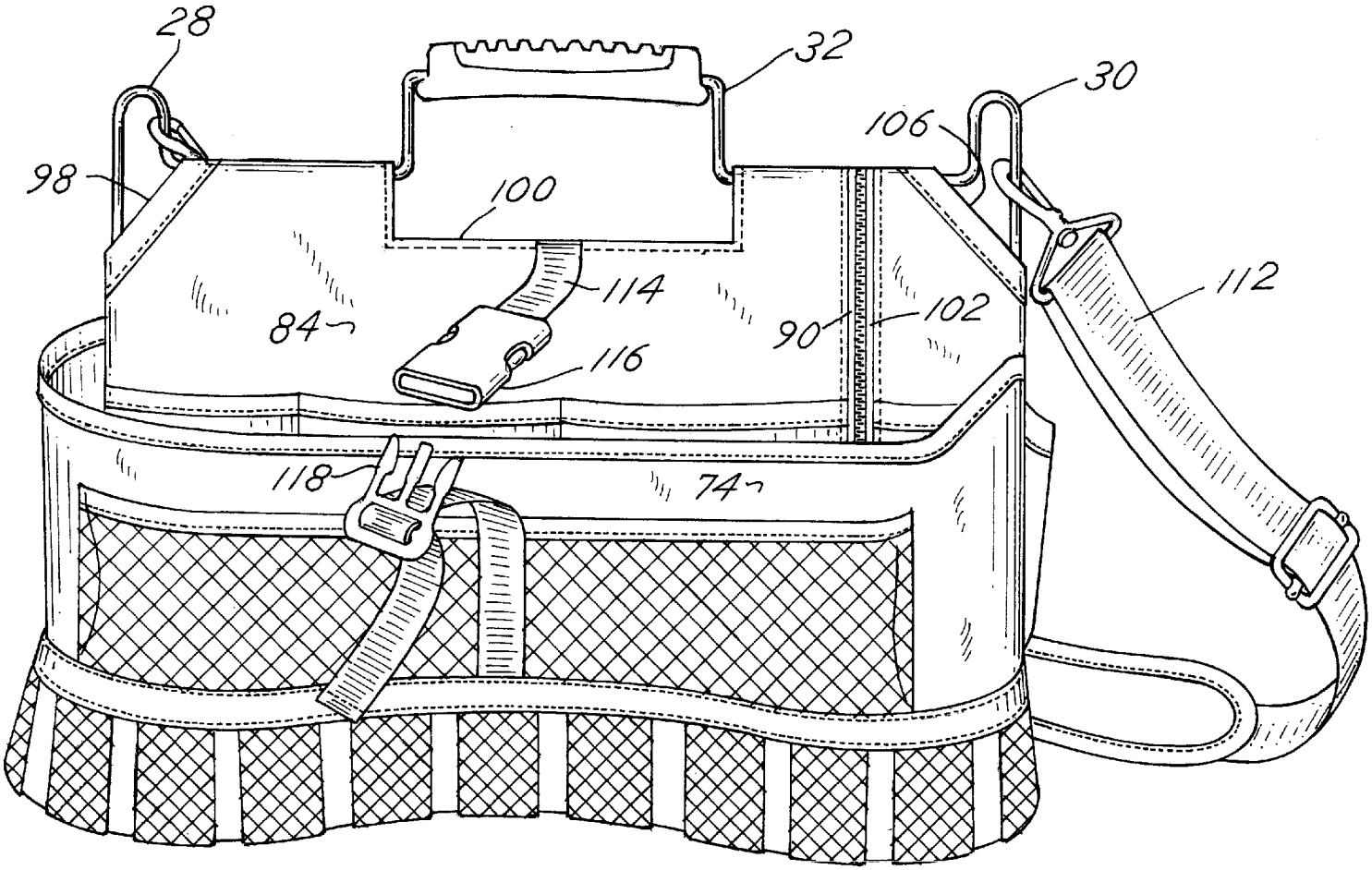
FIG. 7 is an isometric view of the embodiment of FIG. 5 fully assembled for use.

Next referring to FIGS. 5, 6 and 7 there is depicted an alternative embodiment of the invention. In this embodiment, a bottom 70 of the bag is formed from a generally rigid material such as molded rubber or plastic material. The configuration of the bag may thus be controlled or adjusted by means of the shape of the bottom 70. For example, the profile of the bottom 70 may be that of a kidney shape so that the bag may easily be carried by a worker or tradesman on his or her hip. That is, a kidney shaped bag will have a concave side which will easily fit against the hip of a worker for transport of the bag.

The bottom 70 may include peripheral, upstanding side flange 72 around the circumference of the bottom 70. Circumferential side wall 74 is attached to the flange 72 and extends upwardly to define the interior or enclosure of the bag. The side wall 74 is comprised of a flexible material such as canvas fabric or a vinyl material. Of course, pockets may be formed up of both the inside and outside of the peripheral or circumferential side wall 74.

Positioned within the interior of the enclosure defined by the side wall 74 is a central or midpanel or web 76 which substantially divides the collapsible bag into equal sized, major pockets within the enclosure defined by the side wall 74. The midpanel or web 76 includes a first edge 78 which is preferably attached to the side wall 74 on the inside thereof. Optionally, the web 76 includes a bottom edge 80 which is attached to a rigid planar insert 82 attachable to the inside surface of bottom 70. The insert 82 may be lifted or detached from the bottom 70. The web 76 includes a first sheet or panel 84 and a separate sheet or panel 86, a fastener 88, such as a Velcro fastener, is provided along the lower edge 80 for coaction with a fastener 89 to enclose the tubular enclosure defined by the separate sheets or panels 84 and 86.

The separate sheets 84 and 86 each include a second or inside edge or side 90 and 92, respectively. The edges 90 and 92 may be joined or attached to a midplane web extension 94. The tubular enclosure defined by the panels 84 and 86 further includes a top edge 96 having cut out openings 98, 100 therein. The cut out opening 100 is substantially at the midpoint of the distance between the sides of the enclosure wall or panel 74.

The panel web extension 94 comprises a tubular member, or in other words compatible side sheets or panels to web 76 and a zipper fastener 102 along an edge thereof cooperative with the zipper fastener 90, 92 of the midpanel web 76. The web extension 94 further includes a top edge 104 with an open passageway or opening 106.

A frame 108 having a construction similar to the frame depicted in FIG. 3 is provided to fit within the tube enclosure defined by the panels 84 and 86 and the web extension 94. Thus the zipper connection 90, 92, 102 is first disconnected. The frame 108 is then inserted in the tube of web 76 and extension 94 and fitted in the manner depicted in FIG. 6 so that the end loop 28, 30 as well as the handle 32 are fitted through the appropriate openings 98, 100, and 106. The zipper connection 90, 92, 102 is closed thereby encompassing the frame 108. The insert or base 82 may then be fastened to bottom 70.

A carry strap 112 may be attached to the loops 28, 30. A pocket retention strap 114 fixed to the web 84 includes a fastener 116 connectible with a fastener 118 attached to the side panel 74. This is a strap construction similar to the first embodiment previously described.

Both the first and second embodiments may thus be easily assembled or disassembled. For the second embodiment of FIGS. 5 and 6, removal of the frame 108 by detaching or unfastening the zipper 90, 92, 102 and removing the fasteners 88, 90 will permit the removal of the frame 108. In this manner, the entire assembly and more particularly the peripheral side wall 74 may be folded with the midpanel or connecting web 76 into a flat condition and placed in a packing box for display. Thus the assembly provides a rigid shaped tool carrier bag when assembled yet on the other hand may be disassembled for ease of packaging, storage, etc.

As depicted in the figures, the collapsible fabric bag may include pockets of various size and description for holding various types of tools. Subpockets or pouches may be positioned on the outside of the collapsible bag or inside the bag. Thus, while there has been set forth a preferred embodiment of the invention, it is to be understood that the invention is to be limited only by the following claims and equivalents thereof.

What is claimed is:

1. A portable, collapsible tool carrier, comprising, in combination:

a wire frame including a straight bottom run, having first and second, spaced ends, a first side run extending upwardly from the first end of the bottom run, a second side run extending upwardly from the second end of the bottom run, a top run connecting the side runs and spaced from the bottom run to form the frame, said top run including first and second end loops at the intersection respectively of the first side run and top run and the second side run and top run; and a fabric bag having a first pocket with an open top and a second pocket with an open top said first pocket and said second pocket arrayed back to back and connected to each other by a flexible web with the open top of each bag directed upwardly from the bottom run towards the top run, said web fitted over the top run of the frame to thereby support a pocket on each side of the frame.

2. The carrier of claim 1 further including a strap connected from the web to a pocket to hold the pocket open.

3. The carrier of claim 1 further including a carrier strap connecting the frame loops.

4. The carrier of claim 1 further including a handle formed on the top run of the frame said web having an opening, said handle projecting through the opening in the web to facilitate carrying of the tool carrier.

5. The carrier of claim 1 wherein the frame includes a transverse base member attached to the bottom run to support at least one of the pockets.

6. The carrier of claim 1 further including a rectangular frame attached to the bottom run transverse to a plane defined by the wire frame.

* * * * *